US008596090B1

(12) United States Patent
Smith

(10) Patent No.: US 8,596,090 B1
(45) Date of Patent: Dec. 3, 2013

(54) JEWELLERY ARTICLE WITH MAGNETIC ELEMENTS

(76) Inventor: Robert D Smith, Dartmouth (CA)

( * ) Notice: Subject to any disclaimer, the term of this patent is extended or adjusted under 35 U.S.C. 154(b) by 38 days.

(21) Appl. No.: 13/494,066

(22) Filed: Jun. 12, 2012

(51) Int. Cl.
*A44C 17/02* (2006.01)

(52) U.S. Cl.
USPC ..... 63/29.2; 63/900; 63/40; 24/303

(58) Field of Classification Search
USPC ..... 63/29.2, 40, 900; 24/303, 66.1; 5/693; 16/320; 40/372; 74/572.21; 49/478.1; 53/343
See application file for complete search history.

(56) References Cited

U.S. PATENT DOCUMENTS 2,752,764 A * 7/1956 Lederer ..... 63/29.1
3,509,734 A 5/1970 Lederer
4,231,137 A * 11/1980 Fujimoto ..... 24/303
4,982,581 A * 1/1991 Furuyama ..... 63/29.1
5,099,659 A * 3/1992 Carranza et al. ..... 63/3
5,806,346 A * 9/1998 Schlinger et al. ..... 63/40
6,594,871 B2 * 7/2003 Hoffman ..... 24/303
7,640,636 B2 * 1/2010 Clark ..... 24/303

* cited by examiner

*Primary Examiner* — Jack W. Lavinder
*Assistant Examiner* — Abigail E Morrell
(74) *Attorney, Agent, or Firm* — Xiang Lu; Gowling Lafleur Henderson LLP

(57) ABSTRACT

An interchangeable jewelry insert for detachable attachment to a receptacle is described. The jewelry insert has a body with two ends, the first end has at least one dimension sized to fit within a receiving aperture of the receptacle of the item, the second end has at least one dimension larger than the receiving aperture. The first end of the body has a first magnetic element. The receiving aperture has a second magnetic element. The first magnetic element and the second magnetic element provide a repelling force to secure the interchangeable jewelry insert to the receptacle.

20 Claims, 4 Drawing Sheets

(A)

(B)

(A)

(B)

(A)

(B)

JEWELLERY ARTICLE WITH MAGNETIC ELEMENTS

FIELD OF INVENTION

The present invention relates to the field of jewellery. More particularly, the present invention relates to an interchangeable jewellery insert, and an item having a receptacle for magnetically securing the interchangeable insert.

BACKGROUND OF THE INVENTION

Jewellery has been with humanity since the beginning as people have always felt the need to adorn themselves for a variety of reasons including a sense of individuality, beauty and simply as a means of attracting attention. Jewellery is a multi-billion dollar worldwide business.

The ability to interchange, personalize and accessorize has always been a facet of the jewellery industry. It is an innate human desire to transform an item from an object one has purchased to an object that resonates with the owners personality, clothing or current moods. In modern times many different people have brought forward ideas to aid people in accomplishing this.

U.S. Pat. Nos. 6,427,487 to Morgan, 5,414,948 to Kudo, 6,588,067 to Efron et al., 6,026,658 to Weller, 4,374,470 to Isaacson, and 6,742,359 to Takessian, all disclose jewellery items with interchangeable inserts. Each of these jewellery items requires manipulation of moving or moveable parts in order to change and secure an insert.

Use of opposite polarized magnetic elements to join components is known in the field. For example, permanent magnets can be used to hold two jewellery components which are made of different types of precious metals and stones.

U.S. Pat. Nos. 7,013,674 to Kretchmer, and 6,851,279 to Hargrove, US patent applications 2006/0137396 by Ma, and 2006/0075781 by Kretchmer et al., describe jewellery items which include one or more magnets providing attractive force between the jewellery components.

U.S. Pat. No. 7,409,837 to Robert Smith describes an interchangeable jewellery insert for detachable attachment to a receptacle, the insert comprises a body with an end having at least one dimension sized to fit within a receiving aperture of the receptacle. The other end of the insert has at least one dimension larger than an inward extension of the receiving aperture. The insert has an extension formed of elastic material and coupled to the body. The extension is a closed continuous circuit along a periphery of the body, and extends outward and is deformed by the inward extension of the receptacle. The extension frictionally engages a surface of the receiving aperture.

The jewellery insert of an interchangeable jewellery may be difficult to exchange as the magnetic force attracting the jewellery components may be quite strong, especially where permanent, rare earth magnets are used.

For non-magnetic interchangeable jewellery items, frictional engagement between the insert and the receptacle is generally required. This may have the dual disadvantages that the use may need a rod-like instrument, such as a pen, to remove the insert from the receptacle, and that a strict manufacturing requirement for the dimension of the parts is needed. This requirement also results in the absence of any movement freedom for the insert within the receptacle which may be a desired feature for the consumer.

Accordingly, there is a need for improvement of an interchangeable jewellery insert that can be conveniently attached to or detached from a jewellery item.

SUMMARY OF THE INVENTION

The present invention relates to the field of jewellery. More particularly, the present invention relates to an interchangeable jewellery insert, an item having a receptacle for magnetically securing the interchangeable insert.

In accordance with one embodiment of the present invention there is provided an interchangeable jewellery insert for detachable attachment to a receptacle of an item, the interchangeable jewellery insert comprises a body having a first end and a second end. The first end has at least one dimension sized to fit within a receiving aperture of the receptacle of the item. The second end has at least one dimension larger than the receiving aperture. The interchangeable jewellery insert further comprises a first magnetic element joining the first end of the body, the first magnetic element has a first surface facing the second end of the body, the surface defining a first plane. The receiving aperture includes a second magnetic element having an end, the end defining a second plane. The first magnetic element and the second magnetic element provide a repelling force to secure the interchangeable jewellery insert to the receptacle, when the interchangeable jewellery insert is placed in the receptacle, the first plane passes through the second plane, and the first magnetic element and the second magnetic element are located on opposite sides of the first plane and the second plane.

Preferably, the body is cylindrical and wherein the first magnetic element is a circular disc at the first end.

Preferably, the second magnetic element is a ring adjacent and concentric to the receiving aperture.

Preferably, the body defines a first axis and wherein a polarity of the first magnetic element is parallel to the first axis.

Preferably, the ring defines a second axis and wherein a polarity of the second magnetic element is parallel to the second axis.

Preferably, the second axis overlaps the first axis.

Preferably, the north poles of the first magnetic element and the second magnetic element are on the opposite sides of the first plane and the second plane and proximate to each other.

Preferably, the south poles of the first magnetic element and the second magnetic element are on the opposite sides of the first plane and the second plane and proximate to each other.

Preferably, the north pole of the first magnetic element and the north pole of the second magnetic element are in proximity.

In accordance with one embodiment of the present invention there is provided an item having the receptacle for detachably attaching the interchangeable jewellery insert as described above.

Preferably, the item is selected from the group consisting of ring, earring, pendant, bracelet, necklace, pin, brooch, button, grommet, key chain, pen, golf hat, baseball hat, zipper pull, handbag, backpack, belt, shoe, clothing, watch strap, pet jewellery, sunglasses, and body piercing jewellery.

Preferably, the receptacle comprises: a base and a sidewall, the base sized to fit the second end of the body of the interchangeable jewellery insert, the sidewall defining the receiving aperture.

Preferably, the sidewall is continuous.

Preferably, the base comprises an opening.

Preferably, additional frictional force is present between the interchangeable jewellery insert and the receptacle.

Preferably, at least one of the first magnetic element the second magnetic element is a permanent magnet.

This summary of the invention does not necessarily describe all features of the invention.

BRIEF DESCRIPTION OF THE DRAWINGS

These and other features of the invention will become more apparent from the following description in which reference is made to the appended drawings wherein:

FIG. 1 (B) is a sectional view of an exemplary receptacle in accordance with one embodiment of the present invention;

FIG. 2 (B) is a detailed view of the interaction between the interchangeable jewellery insert and the receptacle;

FIG. 4 (B) shows sectional view of the ring having the interchangeable insert attached within the receptacle.

DETAILED DESCRIPTION OF PREFERRED EMBODIMENTS

Figure 1:
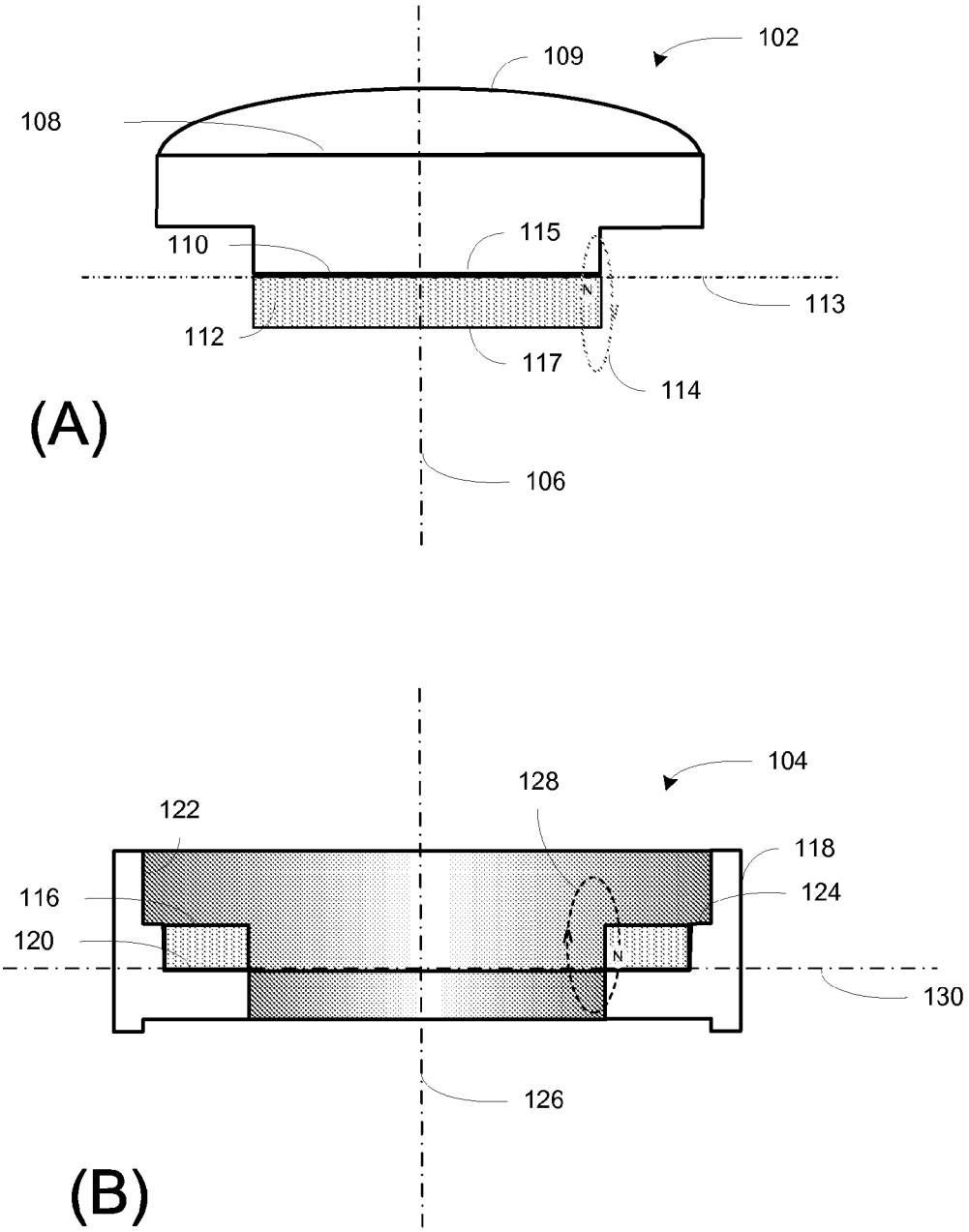
FIG. 1 (A) provides a sectional view of an interchangeable jewellery insert in accordance with one embodiment of the present invention.

The present invention relates to a jewellery article comprising an interchangeable jewellery insert and a receptacle thereof, each configured and dimensioned in a predetermined shape and having a magnetic element for repulsive magnetic association with the other. The magnetic elements repulse each other with a magnetic strength.

Different types of items for receiving an interchangeable jewellery insert can use the present invention. Jewellery types that can be worn on the body or through parts of the body are contemplated. Jewellery types that can be incorporated into clothing or other articles are also contemplated. Furthermore, items may be common objects such as bags, shoes, pens, key chains, or zipper pulls, that have been configured to receive a jewellery insert and are thereby transformed into a jewellery item. In certain examples, interchangeable inserts may be interchangeable amongst all jewellery types including, rings, earrings, pendants, bracelets, necklaces, pins and brooches and body piercing jewellery. In other examples, interchangeable inserts may fit in grommets, pens, zipper pulls, watch straps, shoes, bags, belts, handbags, hats, backpacks, clothing, key chains, leather wristbands, and pet jewellery. As will be recognized by persons skilled in the art, an item surface may be manufactured to have a receptacle for receiving an interchangeable jewellery insert. Interchangeable inserts and their receptacles may be standardized such that a single interchangeable insert can fit into a variety of items, or that a single item can be fitted with a variety of inserts.

In examples of the present invention a jewellery item has a receptacle or chamber for receiving an interchangeable insert. The interchangeable jewellery insert comprises a body with two ends. One end has one dimension sized to fit within a receiving aperture of the receptacle of the item and has a magnet element. The other end has at least one dimension larger than the receiving aperture. The receiving aperture also has a magnetic element. The magnetic element on the interchangeable jewellery insert and the magnetic element on the receiving aperture provide a repelling or repulsing force to secure the interchangeable jewellery insert to the receptacle.

In examples of the present invention, the body of the interchangeable jewellery insert is cylindrical and magnetic element on the interchangeable jewellery insert is a circular disc. The magnetic element on the receiving aperture is a ring.

In examples of the present invention, the body defining an axis and a polarity of the magnetic element of the interchangeable jewellery insert is parallel to the axis. The ring on the receiving aperture defines another axis and the polarity of the ring is parallel to this axis. When the interchangeable jewellery insert is coupled to the receptacle, the axis of the interchangeable jewellery insert overlaps the axis of the ring.

In examples of the present invention, the north pole of the ring defines a plane perpendicular to the axis. The magnetic element of the interchangeable jewellery insert and the ring are on the opposite of the plane when the interchangeable jewellery insert is placed in the receptacle. The north pole of the magnetic element of the interchangeable jewellery insert and the north pole of the ring are in proximity.

In examples of the present invention, the south pole of the ring defines a plane perpendicular to the axis. The magnetic element of the interchangeable jewellery insert and the ring are on the opposite of the plane when the interchangeable jewellery insert is placed in the receptacle. The south pole of the magnetic element of the interchangeable jewellery insert and the south pole of the ring are in proximity.

In examples of the present invention, the jewellery item is a ring, an earring, a pendant, a bracelet, a necklace, a pin, a brooch, a button, a grommet, a key chain, a pen, a zipper pull, a handbag, a backpack, a belt, a shoe, a clothing, a watch strap, a pet jewellery, sunglasses, or a body piercing jewellery.

The body of the interchangeable insert may be made of any suitable material. In certain examples, a body having a metal housing that is identical to the metal of the jewellery item may be used; the metal housing having at least one dimension sized to fit within a receptacle, and further the metal housing may incorporate decorative elements. In other examples the body may be devoid of metal and may be made entirely of stone, such as a gem, with the stone being cut to fit within a receptacle of a jewellery item. The body may be of any material known to a jewellery manufacturer including, without limitation, metal, stone, enamel, glass, plastic, ceramic, leather, rubber or combinations thereof.

The body of an interchangeable insert may be any shape provided that it has at least one dimension that is sized to fit within opposing points of a base of a jewellery item receptacle or within opposing points of a sidewall in examples where such opposing sidewalls are provided. For example, the body shape may be spherical, pyramidal, cubic, tubular, cylindrical, toroid, spiral, tetrahedral, polyhedral, helical, ziggurat, inverted ziggurat, conical, prismatic or any combination thereof.

The present invention is further illustrated using examples that are depicted in the figures.

FIG. 1 (A) provides a sectional view of an interchangeable jewellery insert 102 that can be detachably attached to the receptacle 104 shown in FIG. 1 (B). The interchangeable jewellery insert 102 has a body with two ends 108, 110, which define an axis 106. In the embodiment illustrated in FIG. 1 (A), a first end 108 has a greater diameter than the second end 110, and the jewellery insert 102 has some ornamental features 109. In FIG. 1 (A), a magnetic element 112 is attached at the end 110. The magnetic element 112 has a polarity which is parallel to the axis of the interchangeable jewellery insert 102, i.e. vertical in FIG. 1 (A) with the north pole pointing upwards. A magnetic field line 114 is shown in FIG. 1 (A). The magnetic element 112 has two surfaces, a first surface 115 facing towards the second end 110 of the body, and a second surface 117 facing downwards. In FIG. 1 (A), the first surface 115 defines a first plane 113.

The magnetic element may be a permanent magnet. The permanent magnet may be, but not limited to, a ferrite magnet, an alnico magnet, a rare earth-neodymium magnet, a rare earth-samarium cobalt magnet, or a sintered neodymium-iron-boron compound. The required dimensions and magnetic force for the magnetic elements depends on a number of variables, including the dimensions and weights of the interchangeable jewellery insert. Determining the required dimensions and magnetic force for the magnetic elements on such variables falls within the ability of one having ordinary skill in the art.

FIG. 1 (B) is a sectional view of an exemplary receptacle 104 which is adapted to receive and hold the interchangeable jewellery insert 102 through magnetic repulsion force. The receptacle 104 comprises two concentric rings 116, 118. The outer ring 118 may form part of a jewellery item. The outer ring 118 has a base 120 and sidewall 122 defining an interior cylinder that is sized to receive the interchangeable jewellery insert 102 shown in FIG. 1 (A). In a plane that is substantially parallel to the base 120 of the receptacle, the sidewall 122 may comprise an inward extension 124 extending towards a central axis 126 of the receptacle. In the embodiment shown in FIG. 1 (B), the inner ring 116 is another magnetic element having a polarity which is also parallel to the central axis 126 with the north pole pointing downwards. A magnetic field line 128 is shown in FIG. 1 (B). The second magnetic element 116 has two poles or two ends. In FIG. 1 (B), the north pole or lower end defines another plane or second plane 130.

Figure 2:
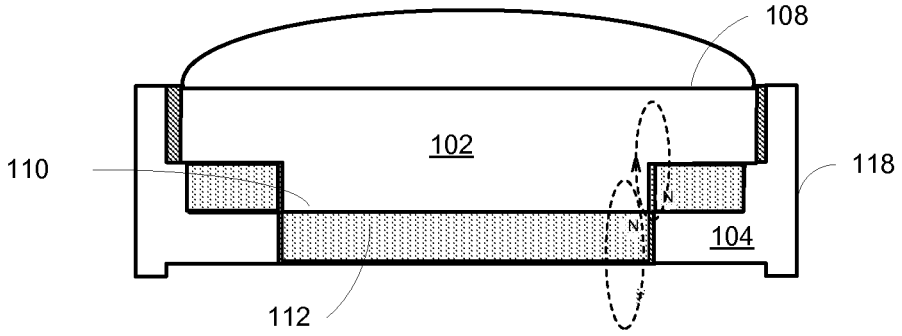
FIG. 2 (A) shows an assembled view of the receptacle having the interchangeable jewellery insert.
Figure 2:
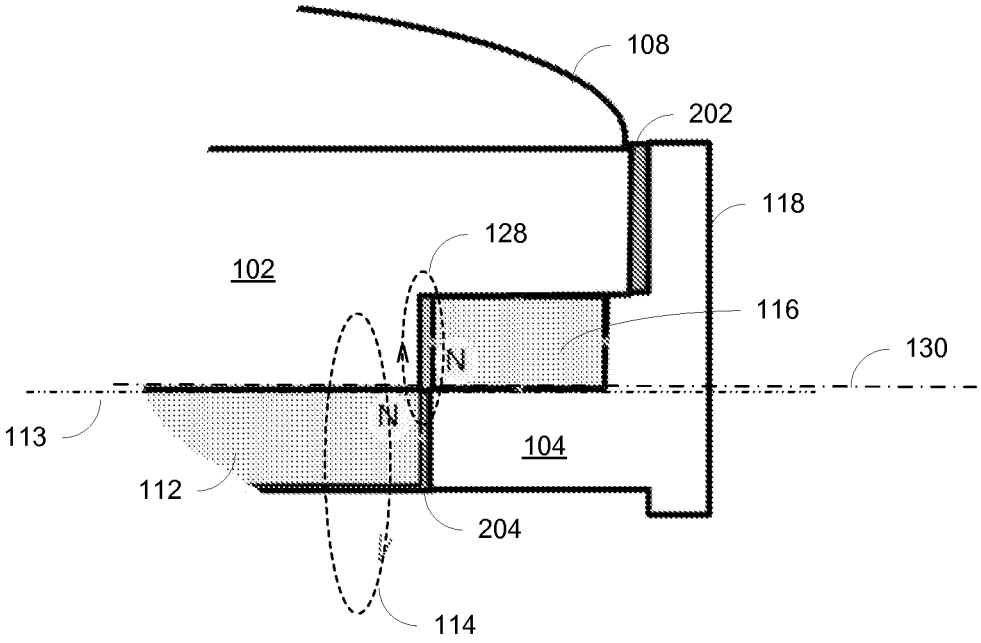

To attach the interchangeable jewellery insert 102 into the receptacle 104, the interchangeable insert is simply placed into the receptacle. FIG. 2 (A) shows an assembled view of the receptacle having the interchangeable insert 102 attached within the receptacle 104. The interchangeable insert 102 has a cylindrical body with a magnetic element 112. FIG. 2 (B) is a detailed view of the interaction between the interchangeable jewellery insert 102 and the receptacle 104. When the upper surface of the magnetic element 112, i.e. the first plane 113, is at or below the base 120, i.e. the lower surface of the magnetic element 112 which defines the second plane 130, the same poles, in the example shown in FIGS. 2 (A) and 2 (B), the north poles magnetically repel one another. In other words, the first magnetic element 112 and the second magnetic element 116 are located on opposite sides of the first plane 113 and the second plane 130. The magnetic repelling force between the interchangeable insert 102 and the receptacle 104 secures the interchangeable jewellery insert 102 in the receptacle 104. Between the interchangeable insert 102 and the receptacle 104 there may exist a gap 202, 204. The embodiments of the present invention therefore do not rely on a frictional force between the interchangeable insert 102 and the receptacle 104 to hold them assembled. It should be apparent to a person skilled in the art that additional frictional force may assist the securing of interchangeable insert in the receptacle. Furthermore, because the interchangeable jewellery insert 102 is held by the magnetic repelling force, certain movement freedom may be provided by the dimensions of the interchangeable jewellery insert 102 and the receptacle 104.

Figure 3:
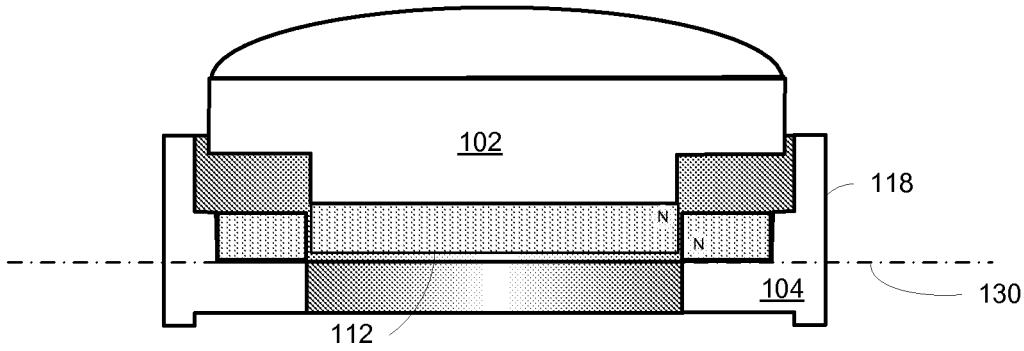
FIG. 3 (A) and FIG. 3 (B) show the removal of the interchangeable jewellery insert from the receptacle.
Figure 3:
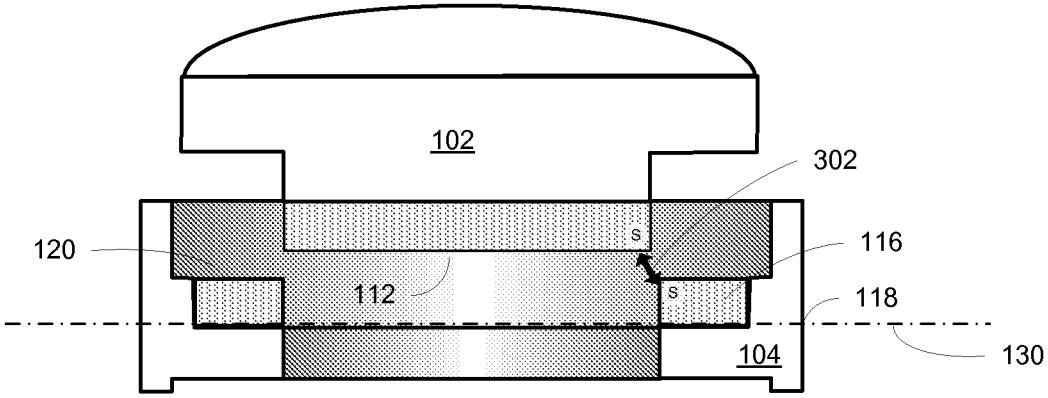

To remove the interchangeable insert 102, a gentle push to the receptacle 104 will cause the poles of the interchangeable insert 102 and the receptacle 104 to pass each other as illustrated in FIG. 3 (A). Once the bottom of the magnetic element 112 is above the second plane 130 the repelling force 302 between the interchangeable insert 102 and the receptacle 104 will cause the interchangeable insert 102 to be pushed out of the receptacle 104. As shown in FIG. 3 (B), the repelling force 302 is provided by the two other poles of the magnetic elements 112, 116, rather than the poles which hold the interchangeable insert 102 in the receptacle 104. In this example, the south poles of the magnetic elements 112, 116 assist the removal of the interchangeable insert 102 from the receptacle 104.

Figure 4:
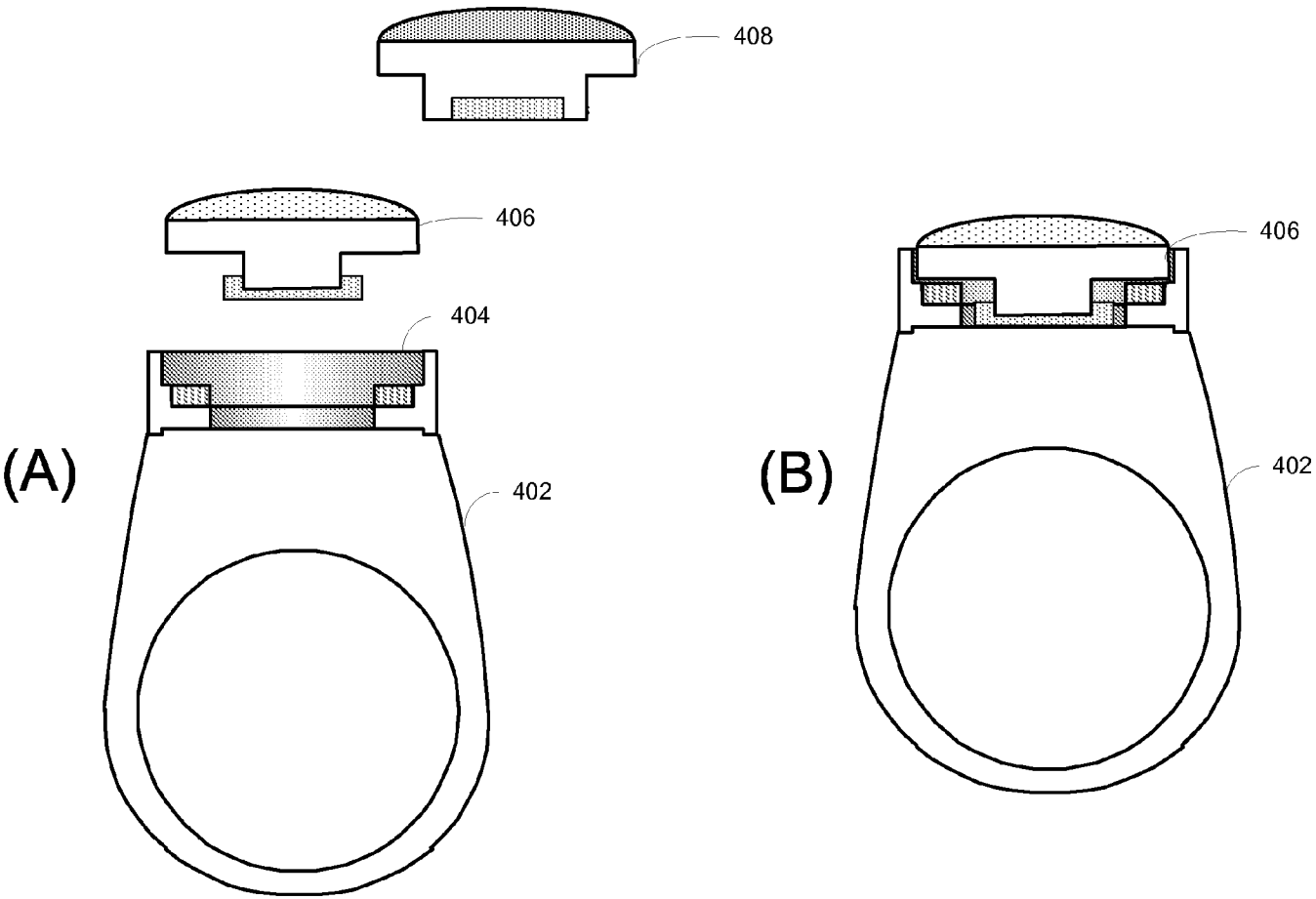
FIG. 4 (A) shows sectional views of a ring with an empty receptacle and a separate interchangeable jewellery insert.

FIG. 4 (A) shows sectional views of a ring 402 having an empty receptacle 404 and two separate interchangeable jewellery inserts 406, 408 and FIG. 4 (B) shows sectional view of the ring 402 having the interchangeable insert 406 attached within the receptacle 404. It should be apparent to a person skilled in the art that the interchangeable inserts 406, 408 are none limiting embodiments of the present invention. Many modifications may be implemented with two magnetic elements providing a repelling force to hold the interchangeable insert attached to the receptacle 404.

The interchangeable insert 102 that will fit a receptacle may also be found in clothing and other articles including, without limitation, jeans, jean jackets and shirts etc., belts, handbags, leather wristbands, hats and even pet jewellery.

While the patent disclosure is described in conjunction with the specific embodiments, it will be understood that it is not intended to limit the patent disclosure to the described embodiments. On the contrary, it is intended to cover alternatives, modifications, and equivalents as may be included within the scope of the patent disclosure as defined by the appended claims. In the above description, numerous specific details are set forth in order to provide a thorough understanding of the present patent disclosure. The present patent disclosure may be practiced without some or all of these specific details.

The terminology used herein is for the purpose of describing particular embodiments only and is not intended to be limiting of the patent disclosure. As used herein, the singular forms "a", "an" and "the" are intended to include the plural forms as well, unless the context clearly indicates otherwise. It will be further understood that the terms "comprises" or "comprising", or both when used in this specification, specify the presence of stated features, integers, steps, operations, elements, and/or components, but do not preclude the presence or addition of one or more other features, integers, steps, operations, elements, components, and/or groups thereof.

It is further understood that the use of relational terms such as first and second, and the like, if any, are used solely to distinguish one from another entity, item, or action without necessarily requiring or implying any actual such relationship or order between such entities, items or actions.

All citations are hereby incorporated by reference.

What is claimed is:

1. A jewellery comprising an interchangeable jewellery insert and a receptacle, the receptacle having a receiving aperture, the interchangeable jewellery insert comprising:

a body having a first end and a second end, the first end having at least one dimension sized to fit within the receiving aperture, the second end having at least one dimension larger than the receiving aperture; and a first magnetic element joining the first end of the body, the first magnetic element having a first surface facing the second end of the body, the first surface defining a first plane;

the receptacle comprising: a base and a sidewall, the base sized to fit the second end of the body of the interchangeable jewellery insert, the sidewall defining the receiving aperture;

wherein the receiving aperture includes a second magnetic element having an end, the end defining a second plane; and wherein the first magnetic element and the second magnetic element provide a repelling force to secure the interchangeable jewellery insert to the receptacle, when the interchangeable jewellery insert is placed in the receptacle, the first plane passes through the second plane, and the first magnetic element and the second magnetic element are located on opposite sides of the first plane and the second plane.

2. The jewellery of claim 1, wherein the body is substantially cylindrical and wherein the first magnetic element is a circular disc at the first end.

3. The jewellery of claim 1, wherein the second magnetic element is a ring adjacent and concentric to the receiving aperture.

4. The jewellery of claim 3, wherein the ring defines a second axis and wherein a polarity of the second magnetic element is parallel to the second axis.

5. The jewellery of claim 4, wherein the second axis overlaps the first axis.

6. The jewellery of claim 1, wherein the body defines a first axis and wherein a polarity of the first magnetic element is parallel to the first axis.

7. A method for attaching an interchangeable jewellery insert to a receptacle of an item, the method comprising:

providing the interchangeable jewellery insert comprising:

a body having a first end and a second end; and a first magnetic element joining the first end of the body, the first magnetic element having a first surface facing the second end of the body, the first surface defining a first plane;

and inserting the interchangeable jewellery insert into a receiving aperture of the receptacle of the item;

wherein the first end has at least one dimension sized to fit within the receiving aperture of the receptacle of the item, the second end has at least one dimension larger than the receiving aperture;

wherein the receiving aperture includes a second magnetic element having an end, the end defining a second plane;

wherein the first magnetic element and the second magnetic element provide a repelling force to secure the interchangeable jewellery insert to the receptacle, when the interchangeable jewellery insert is placed in the receptacle, the first plane passes through the second plane, and the first magnetic element and the second magnetic element are located on opposite sides of the first plane and the second plane.

8. The method of claim 7, wherein the body is substantially cylindrical and wherein the first magnetic element is a circular disc at the first end.

9. The method of claim 8, wherein the second magnetic element is a ring adjacent and concentric to the receiving aperture.

10. The method of claim 9, wherein the body defines a first axis and wherein a polarity of the first magnetic element is parallel to the first axis.

11. The method of claim 10, wherein the ring defines a second axis and wherein a polarity of the second magnetic element is parallel to the second axis.

12. The method of claim 11, wherein the second axis overlaps the first axis.

13. The method of claim 11, wherein the north poles of the first magnetic element and the second magnetic element are on the opposite sides of the first plane and the second plane and proximate to each other.

14. The method of claim 11, wherein the south poles of the first magnetic element and the second magnetic element are on the opposite sides of the first plane and the second plane and proximate to each other.

15. A method for receiving an interchangeable jewellery insert in an item, the method comprising:

providing the item; and inserting the interchangeable jewellery insert into the item;

wherein the interchangeable jewellery insert comprises:

a body having a first end and a second end, the first end having at least one dimension sized to fit within a receiving aperture of a receptacle of the item, the second end having at least one dimension larger than the receiving aperture; and a first magnetic element joining the first end of the body, the first magnetic element having a first surface facing the second end of the body, the first surface defining a first plane;

wherein the receiving aperture includes a second magnetic element having an end, the end defining a second plane;

wherein the first magnetic element and the second magnetic element provide a repelling force to secure the interchangeable jewellery insert to the receptacle, when the interchangeable jewellery insert is placed in the receptacle, the first plane passes through the second plane, and the first magnetic element and the second magnetic element are located on opposite sides of the first plane and the second plane; and wherein the item is selected from the group consisting of ring, earring, pendant, bracelet, necklace, pin, brooch, button, grommet, key chain, pen, golf hat, baseball hat, zipper pull, bag, shoe, backpack, belt, shoe, clothing, watch strap, pet jewellery, sunglasses, and body piercing jewellery.

16. The method of claim 15, wherein the receptacle comprises: a base and a sidewall, the base sized to fit the second end of the body of the interchangeable jewellery insert, the sidewall defining the receiving aperture.

17. The method of claim 16, wherein the sidewall is continuous.

18. The method of claim 16, wherein the base comprises an opening.

19. The method of claim 16, wherein additional frictional force is present between the interchangeable jewellery insert and the receptacle.

20. The method of claim 16, wherein at least one of the first magnetic element and the second magnetic element is a permanent magnet.

* * * * *